United States Patent [19]

Rind

[11] 4,020,833

[45] May 3, 1977

[54] OXYGEN SOURCE FOR HUMAN RESPIRATION REQUIREMENTS

[76] Inventor: Harold Rind, 46 Southwood Circle, Syosset, N.Y. 11791

[22] Filed: June 21, 1976

[21] Appl. No.: 697,824

[52] U.S. Cl. ..... 128/142 R; 128/191 R; 252/186; 23/281; 252/188.3 R

[51] Int. Cl.[2] ..... A62B 7/00

[58] Field of Search ..... 128/142 R, 191 R, 188, 128/142.6; 252/186, 188.3 R; 23/281

[56] References Cited

UNITED STATES PATENTS

| | | | |
|---|---|---|---|
| 3,174,936 | 3/1965 | Gustafson et al. | 252/186 |
| 3,293,187 | 12/1966 | Markowitz | 252/186 |
| 3,655,346 | 4/1972 | Cotabish et al. | 128/191 R |
| 3,920,803 | 11/1975 | Boryta | 252/186 |

*Primary Examiner*—Robert W. Michell
*Assistant Examiner*—Henry J. Recla

[57] ABSTRACT

The use in a chemical mixture of a predominant amount (but less than 100%) of potassium superoxide or other similar material to produce a breathing gas for use in respirators, submarines, mines, or the like. The combining chemical absorbs carbon dioxide, but either does not release oxygen or releases a smaller amount of oxygen than does the potassium superoxide. Thus, the environment is effectively cleared of carbon dioxide, but the tendency of the potassium superoxide to overproduce oxygen is obviated since its performance in this respect is reduced by virtue of its combination with a non-oxygen or low-oxygen producing chemical and, most important, the volume of oxygen produced for consumption remains responsive to the individual's respiration quotient, as hereinafter explained.

6 Claims, 5 Drawing Figures

OXYGEN SOURCE FOR HUMAN RESPIRATION REQUIREMENTS

The present invention relates to improvements for providing and maintaining a breathing gas for humans in an enclosed, or polluted, environment, and more particularly to an improved oxygen-generating chemical mixture which advantageously uses potassium superoxide.

While it is known that an individual's respiration quotient, i.e. his volumetric exchange of carbon dioxide and water vapor for oxygen, varies in accordance with individual factors such as his diet or food metabolism, activity level, or the like, prior art emergency or substitution oxygen sources do not take this into account. Thus, a typical prior art oxygen system, as exemplified by U.S. Pat. No. 3,565,068, shows the combination of a carbon dioxide absorber with an oxygen generator, the latter being in the form of an "oxygen candle" which, during use, releases a constant volume of oxygen for consumption, regardless of the individual's changing respiration requirements. The situation is not significantly improved by substituting "bottled" oxygen for the candle, since the setting of the exit valve of the storage "bottle" or the like, must be adjusted to achieve a corresponding change in the rate at which oxygen is made available for consumption.

Broadly, it is an object of the present invention to provide an improved oxygen source for a substitution or emergency oxygen-generating system which overcomes the foregoing and other shortcomings of the prior art. Specifically, the within system effectively uses potassium superoxide as an oxygen-generating source, even though it inherently over-produces oxygen and heat and, heretofore, has not effectively been able to be used in life-support systems of the type contemplated herein. One result, however, in being able to effectively use this chemical, is that the volume of oxygen made available for inhaling is related to the volume of carbon dioxide and water vapor that is exhaled, since potassium superoxide releases oxygen in accordance with the amount of carbon dioxide and water vapor that impinges upon it. Thus, the within life-support system automatically adjusts to the individual's changing respiration requirements, whereas prior art systems cannot be made to similarly perform without complicated valve-changing controls, or similar supervising mechanisms.

A chemical mixture serving as an improved oxygen source to support human respiration needs for use in an environment without adequate oxygen, which demonstrates objects and advantages of the present invention, uses a 90% mixture of potassium superoxide in a particulate form, since this chemical releases oxygen upon impingement thereon of carbon dioxide. The remaining amount of a chemical, also in a particulate form, and in a physically intermixed relation with the potassium superoxide, is selected from a group which is effective to absorb carbon dioxide with little or no production of oxygen. The selected combination thus produces oxygen in an amount less than that which is produced by pure potassium superoxide, and yet still is responsive to the volume of carbon dioxide exhaled by the user and impinging upon the potassium superoxide, the latter of course being a function of the changing respiration requirements of the user.

The above description, as well as further objects, features and advantages of the present invention, will be more fully appreciated by reference to the following detailed description of presently preferred, but nonetheless illustrative embodiments in accordance with the present invention when taken in conjunction with the accompanying drawings, wherein.

Figure 1:
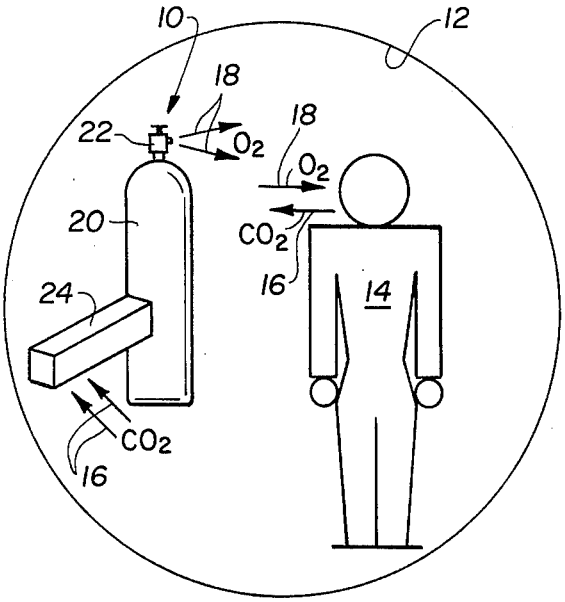
FIG. 1 PRIOR ART
FIG. 1 is a schematic view of a typical prior art system for providing and maintaining a breathing gas for humans in an enclosed environment.

Reference is first made to FIG. 1 which illustrates a typical prior art oxygen source, generally designated 10, that typically would be used to supply human respiration requirements or needs within a confined environment 12, such as a submarine. FIG. 1 also contemplates a substitution oxygen source for use in a respirator in a polluted environment or under emergency conditions in a mine disaster or the like. As generally understood, normal body functioning requires removal of the contaminants generated by the human body during food metabolism and also the replacement of oxygen consumed in that process. This is but another way of stating that the body produces carbon dioxide and water vapor, which is exhaled, and inhales oxygen for consumption by the body, both the exhaling and inhaling being of course on a volumetric basis. The exchange of carbon dioxide and water vapor for oxygen is known as the respiratory quotient, and is known to vary on an individual basis, depending upon the diet of the individual, the activity level, and other such factors. Despite knowledge of the foregoing, a typical prior art source 10, as referred to and illustrated in FIG. 1, does not take into account the individual respiratory quotient of the individual 14 during his exchange of carbon dioxide, designated by the reference arrow 16, and oxygen, designated by reference numeral 18 (water vapor being omitted from consideration for simplicity sake). This is so because the prior art source 10 typically includes a container 20 of pressurized oxygen which is metered therefrom at a prescribed rate by an appropriate setting of an exit valve 22. Thus, the exiting oxygen 18 occurs at a rate which is determined by the setting of the valve 22, and does not vary in accordance with the activity level of the user 14, his degree of changing anxiety, stress, or any other such factor. Naturally, to remove the exhaled carbon dioxide 16 there is usually provided in association with the source of oxygen 20 a chemical carbon dioxide-absorber 24, which may be of any known type, such as calcium oxide or other metal oxide, hydroxide or peroxide. As generally understood, the chemical absorber 24 merely removes, by absorption, any carbon dioxide 16 impinging upon it, but does not release in exchange any significant amount of oxygen for consumption by the user 14.

Figure 2:
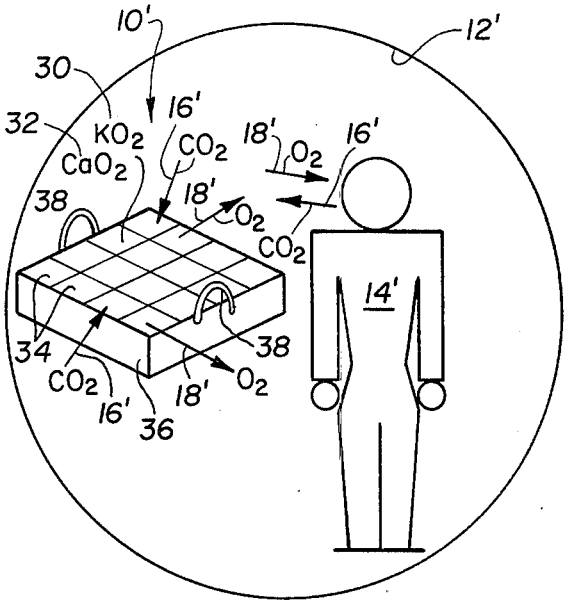
FIG. 2 is a view similar to FIG. 1, but illustrating a first embodiment of a system with an improved oxygen source according to the present invention.
Figure 4:
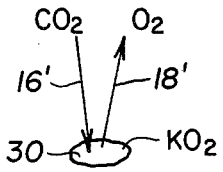
FIG. 4 is a further diagrammatic view illustrating additional features of the improved source.

Before proceeding with a description of FIG. 2, for a comparison with FIG. 1, it is first helpful to note that the improved oxygen source according to the present invention consists of a chemical mixture on which one of the chemicals is potassium superoxide (KO2), designated by the reference numeral 30 in FIG. 4. Alternatively, use can be made of another metal superoxide, such as lithium superoxide. As generally understood, this chemical is available in particulate form, as illustrated in FIG. 4, and its known chemical function is one in which it releases oxygen 18 in an amount or volume which corresponds to the amount of carbon dioxide and water vapor 16 which impinges upon its surface. Specifically, potassium superoxide is known to produce 1.0909 pounds of oxygen per pound of carbon dioxide absorbed, which is about 20% more oxygen than is required for a typical respiration quotient. This also generates an excessive amount of heat. However, as will be subsequently explained, the adverse effect of this over-production of oxygen is adequately eliminated as a factor to be contended with in its use as part of the improved oxygen source of the present invention.

Reference should now be made to FIG. 2 in which, to facilitate comparison of this figure with FIG. 1, similar features are designated by the same, but primed, reference numerals. Individual 14', within the confined environment 12', which may be assumed to be restricted as to area and oxygen supply, requires an exchange of oxygen 18' for exhaled carbon dioxide 16'. In accordance with the present invention, the source for the oxygen 18' is from the improved chemical mixture 10', and this chemical mixture includes an actual physical inter-mixing of potassium superoxide 30 and calcium oxide 32 in a ratio of approximately 90% potassium superoxide and 30 to 10% calcium oxide 32, the exact ratio being related to the specific chemicals used. Instead of calcium oxide, use can also be made of a metallic peroxide which produces only a nominal amount of oxygen while functioning as an efficient absorber of carbon dioxide. The physically inter-mixed chemicals, both in particulate form, are, in the form of the invention illustrated in FIG. 2, disposed in individual compartments, individually and collectively designated 34, of a container 36. Container 36 has appropriate handles 38 or the like for being suspended at a remote location from the individual 14'. In accordance with the present invention, exhaled carbon dioxide and water vapor 16' impinge upon the chemical mixture 30, 32 with two important results. One result, as previously indicated in connection with FIG. 4 is that the carbon dioxide and water vapor 16' which impinges upon the potassium superoxide 30 results in the release therefrom of usable and consumable oxygen 18'. The other result is that some volume of carbon dioxide 16' will impinge upon the 10% of calcium oxide 32 and will be absorbed by this chemical, but it will not result in the release of any oxygen. In effect, therefore, the calcium oxide 32 functions as would be expected as a carbon dioxide absorber, but it also functions in its physically inter-mixed relation to the potassium superoxide to render this chemical ineffective as an oxygen generator, the degree of ineffectiveness being 10% since it constitutes 10% of the total mixture. Stated another way, the 90% of potassium superoxide 30 is only 90% effective as an oxygen source, as compared with a pure 100% potassium superoxide source. Thus, the "ineffective" oxygen-generating potassium superoxide 30 is rendered more useful as an oxygen source for the confined environment 12' since its inter-mixture does not result in an over-production of oxygen.

Figure 3:
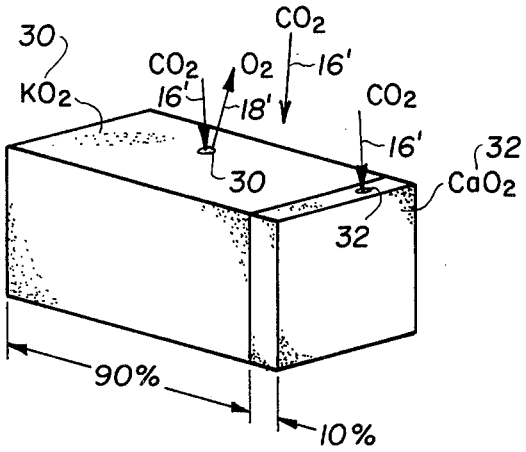
FIG. 3 is a diagrammatic view illustrating features of the improved oxygen source illustrated in FIG. 2.

FIG. 3 is intended to illustrate the manner in which the inter-mixture of potassium superoxide 30 with a carbon dioxide absorber, such as calcium oxide 32, is better adapted to accommodate a typical respiration quotient because of the combined ratio of 90% of the former to 10% of the latter. It will be understood, however, that the two chemicals 30 and 32 are not segregated as illustrated in FIG. 3, but as already explained, the same are physically inter-mixed when used. The segregated illustration as used in FIG. 3 illustrates the prescribed ratio in which these chemicals are used, and how this results in a performance in the chemical mixture, which, in turn, provides an oxygen source that accommodates itself to the respiratory quotient of the user.

To better understand the above mentioned performance of the improved oxygen source 10' of the present invention, reference should again be made to FIGS. 1 and 2 and a comparison therebetween. If it is assumed that the individual 14 in the prior art set-up of FIG. 1 reduces his physical activity, or even holds his breath and does not exhale in a normal manner, from the description already provided it will of course be recognized that there nevertheless will be admitted into the confined environment 12 an unvarying amount of consumable oxygen 18. That is, there is no adjustment in the amount of oxygen exiting from the container 12 through the valve 22, and that his can only be changed by changing the setting of valve 22. In sharp contrast, from the description already provided, it should be readily appreciated that if the individual 14' does not exhale carbon dioxide 16', that there therefore will not be any carbon dioxide impinging upon the potassium superoxide 30 and that this chemical therefore will not generate or produce oxygen. More realistically, if the individual 14' reduces his physical activity, this will correspondingly reduce the amount of carbon dioxide 16' being exhaled, and this will also result in a reduced production of oxygen 18', which is what the situation requires in order to appropriately accommodate to the respiratory quotient of the individual 14'. Similarly, if the individual 14' increases his physical activity, which will require a greater intake of oxygen 18', the increased physical activity will produce the necessary increase in exhaled carbon dioxide 16' to impinge upon the potassium superoxide 30 and produce the necessary amount of consumable oxygen 18'. Thus, in summary, the improved oxygen source 10', unlike the prior art oxygen source 10, automatically adjusts itself in accordance with the respiratory quotient of the user, rather than be operationally dependent upon a particular valve setting, or a change thereof, which is necessary in the operation of a typical prior art system 10.

Figure 5:
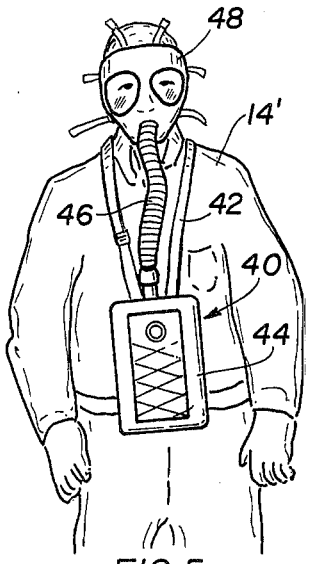
FIG. 5 illustrates another form or embodiment of the improved oxygen source, the same being illustrated in a front perpsective view.

Another form or embodiment of the improved oxygen source according to the present invention is illustrated in FIG. 5. In this embodiment it is contemplated that the individual 14' will wear any one of many available industrial gas masks 40. One appropriate source for mask 40 is Mine Safety Appliance Corp. of Pittsburgh, Pa. As understood, the gas mask 40, typically includes support straps 42 for a cannister 44 which is connected via a conduit or hose 46 to a facial mask 40. In this embodiment, the improved chemical mixture of potassium superoxide and a carbon dioxide absorber, such as calcium oxide, is strategically located within the cannister 44. From the description already provided it should be readily appreciated that in its location within the cannister 44, the chemical mixture 30,

32 provides the same noteworthy performance in supplying oxygen in accordance with the varying respiratory quotient of the individual that is provided in a confined environment 12′, as already explained in connection with FIG. 2.

A latitude of modification, change and substitution is intended in the foregoing disclosure and in some instances some features of the invention will be employed without a corresponding use of other features. Accordingly, it is appropriate that the appended claims be construed broadly and in a manner consistent with the spirit and scope of the invention herein.

What is claimed is:

1. A chemical mixture serving as an improved oxygen source to support human respiration needs for use in an environment without adequate oxygen, said mixture comprising in a prescribed ratio of a predominant amount of a metallic superoxide in particulate form which releases oxygen upon impingement thereon of carbon dioxide and water vapor, and a remaining amount of a chemical also in a particulate form and in a physically intermixed relation to said metallic superoxide, said chemical being of the type which is effective to absorb carbon dioxide without any significant production of oxygen, said prescribed ratio being related to the respiration quotient of the user of said oxygen source and of a selected value wherein said metallic supperoxide is approximately 90% of said mixture, whereby the volume of oxygen produced for consumption is of a selected amount that is less than that which is produced by a pure metallic superoxide and yet still is responsive to the volume of carbon dioxide and water vapor exhaled by the user and impinging upon said metallic superoxide to cause the release of oxygen therefrom.

2. An improved oxygen source as provided by the chemical mixture claimed in claim 1 wherein said metallic superoxide is potassium superoxide.

3. An improved oxygen source as provided by the chemical mixture claimed in claim 2 wherein said chemical mixture is disposed in a container supported on the person of said user, and there is provided a facial mask and a conduit connected in communication between said facial mask and said container.

4. An improved oxygen source as provided by the chemical mixture claimed in claim 1 wherein said environment is limited as to area and oxygen supply, and wherein said chemical mixture is at a location within said confined environment romote from said user.

5. An improved oxygen source as provided by the chemical mixture claimed in claim 1 wherein said carbon dioxide-absorbing chemical is preferably calcium oxide.

6. An improved oxygen source as provided by the chemical mixture claimed in claim 1 wherein said carbon dioxide-absorbing chemical is preferably a metal oxide, metal peroxide or a metal hydroxide.

* * * * *